US007077694B2

(12) United States Patent
Nakano et al.

(10) Patent No.: US 7,077,694 B2
(45) Date of Patent: Jul. 18, 2006

(54) CONNECTOR TO BE FIXED TO A DEVICE AND METHOD OF FIXING A CONNECTOR TO A DEVICE

(75) Inventors: Hiroshi Nakano, Yokkaichi (JP); Kenji Okamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/073,228

(22) Filed: Mar. 4, 2005

(65) Prior Publication Data

US 2005/0221666 A1 Oct. 6, 2005

(30) Foreign Application Priority Data

Mar. 4, 2004 (JP) ..... 2004-060795

(51) Int. Cl.
*H01R 13/369* (2006.01)

(52) U.S. Cl. ..... 439/533; 439/566

(58) Field of Classification Search ..... 439/566, 439/553, 83, 79, 570
See application file for complete search history.

(56) References Cited

U.S. PATENT DOCUMENTS 4,628,410 A * 12/1986 Goodman et al. ..... 361/789
4,802,862 A * 2/1989 Seidler ..... 439/83
4,826,442 A * 5/1989 Douty et al. ..... 439/92
4,911,659 A * 3/1990 Viselli ..... 439/570
5,007,844 A * 4/1991 Mason et al. ..... 439/68
5,096,440 A * 3/1992 Katsumata ..... 439/570
5,194,019 A 3/1993 Rose
5,259,789 A * 11/1993 Patel et al. ..... 439/570
5,591,050 A * 1/1997 Sueoka ..... 439/607
6,007,376 A * 12/1999 Shimizu ..... 439/571
6,325,655 B1 * 12/2001 Noda et al. ..... 439/342
6,780,028 B1 * 8/2004 Kennedy et al. ..... 439/83

FOREIGN PATENT DOCUMENTS

JP 5-326049 12/1993
JP 6-203896 7/1994

* cited by examiner

*Primary Examiner*—Alexander Gilman
(74) *Attorney, Agent, or Firm*—Gerald E. Hespos; Anthony J. Casella

(57) ABSTRACT

Fixing members (30) fixable to a circuit board (K) by soldering are mounted in a housing (10). Each fixing member (30) is comprised of a main panel (31) and a solder leg (32) projecting sideways from the bottom end of the main portion (31). The solder leg (32) has solder entering holes (37) that open at a side of the solder leg (32) toward the circuit board K and at a side opposite therefrom. Each solder entering hole (37) has a cross-section that gradually increases toward both upper and lower open ends (37*a*, 37*b*). A locking portion (38) is formed on each solder entering hole (37) and bulges more inward than both open ends (37*a*, 37*b*). The locking portion (38) locks solder (H) that enters the solder entering hole (37).

11 Claims, 6 Drawing Sheets

CONNECTOR TO BE FIXED TO A DEVICE AND METHOD OF FIXING A CONNECTOR TO A DEVICE

BACKGROUND OF THE INVENTION

1. Field of the Invention

The invention relates to a connector to be mounted to an electric or electronic device, in particular to a circuit board connector, and to a method of mounting or fixing a connector to an electric or electronic device.

2. Description of the Related Art

Japanese Unexamined Patent Publication No. H06-203896 discloses a circuit board connector that has a housing with opposite side surfaces. Board fixing portions are formed integrally with the housing and bulge out sideways from the bottom ends of the opposite side surfaces. The board fixing portions are formed with internally threaded holes. Screws are inserted through screw insertion holes of the circuit board and are fastened to the internally threaded holes.

The outwardly bulging board fixing portions require a large space on the circuit board. Thus, the above-described connector is not well suited for situations where space must be saved.

A circuit board connector could be miniaturized by mounting fixing members on lateral ends of a housing and soldering the fixing members to a circuit board. However, this construction has uncertain mechanical strength as compared to the screw-fastening construction. Thus, there has been a demand to improve fixing reliability to the circuit board.

The present invention was developed in view of the above problem and an object thereof is to improve fixing reliability.

SUMMARY OF THE INVENTION

The invention relates to a connector with a housing that can be mounted to an electric or electronic device, such as a circuit board. At least one fixing member is mountable in the housing and is fixable to the electric or electronic device by soldering. The fixing member includes at least one solder entering recess that opens towards the electric or electronic device and a lock is provided on or near a peripheral edge of the solder entering recess.

Solder enters the solder entering recess to increase the soldering area and to enhance a holding force on the electric/electronic device. Solder that enters the solder entering recess is locked by the lock on the peripheral edge of the solder entering recess to enhance the holding force. As a result, fixing reliability to the electric/electronic device is improved.

The solder entering recess preferably is substantially elliptical. Thus, the soldering area can be increased further as compared to a right circular solder entering recess. Further, burrs are less likely to be formed on the peripheral edge of the solder entering recess as compared to a rectangular solder entering recess.

The cross-section of the solder entering recess preferably increases gradually towards that end that faces the electric/electronic device. Thus, the soldering area can be increased even more.

The solder entering recess preferably is a through hole.

The solder entering recess preferably has a variable width along a height direction, so that the hole diameter gradually increases from an intermediate portion along the height direction toward the open end facing toward the electric or electronic device and towards a substantially opposite open end.

The fixing member preferably comprises a main portion to be mounted in a mount groove in or on the housing.

An escaping surface preferably is formed between the main portion and a solder portion where the solder entering recess is provided.

The escaping surface preferably is slanted and may be formed by striking or machining the outer edge of the intermediate portion between the main portion and a solder portion. A bent portion may be left after the solder portion is formed.

The invention also relates to a method of mounting a connector to an electric or electronic device, such as a circuit board. The method comprises providing an electric or electronic device, mounting at least one fixing member in a connector housing and soldering the fixing member to the electric or electronic device so that the solder can enter into at least one solder entering recess formed in the fixing member and open towards the electric or electronic device. The solder enters the solder entering recess and engages a locking portion near the peripheral edge of the solder entering recess.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A circuit board connector according to the invention is identified by the letter C in FIGS. 1 to 6 and is to be connected with a circuit board K or other electric or electronic device, such as a junction box, dash panel, etc. The connector C includes a housing 10 and terminal fittings 20 are mounted in the housing 10. Fixing members 30 are mountable into the housing 10 for fixing the housing 10 to the circuit board K. In the following description, a side (right side in FIG. 3) of the housing 10 to be connected with the mating housing is referred to as the front, and reference is made to all the figures except FIG. 2 concerning the vertical direction.

Figure 1:
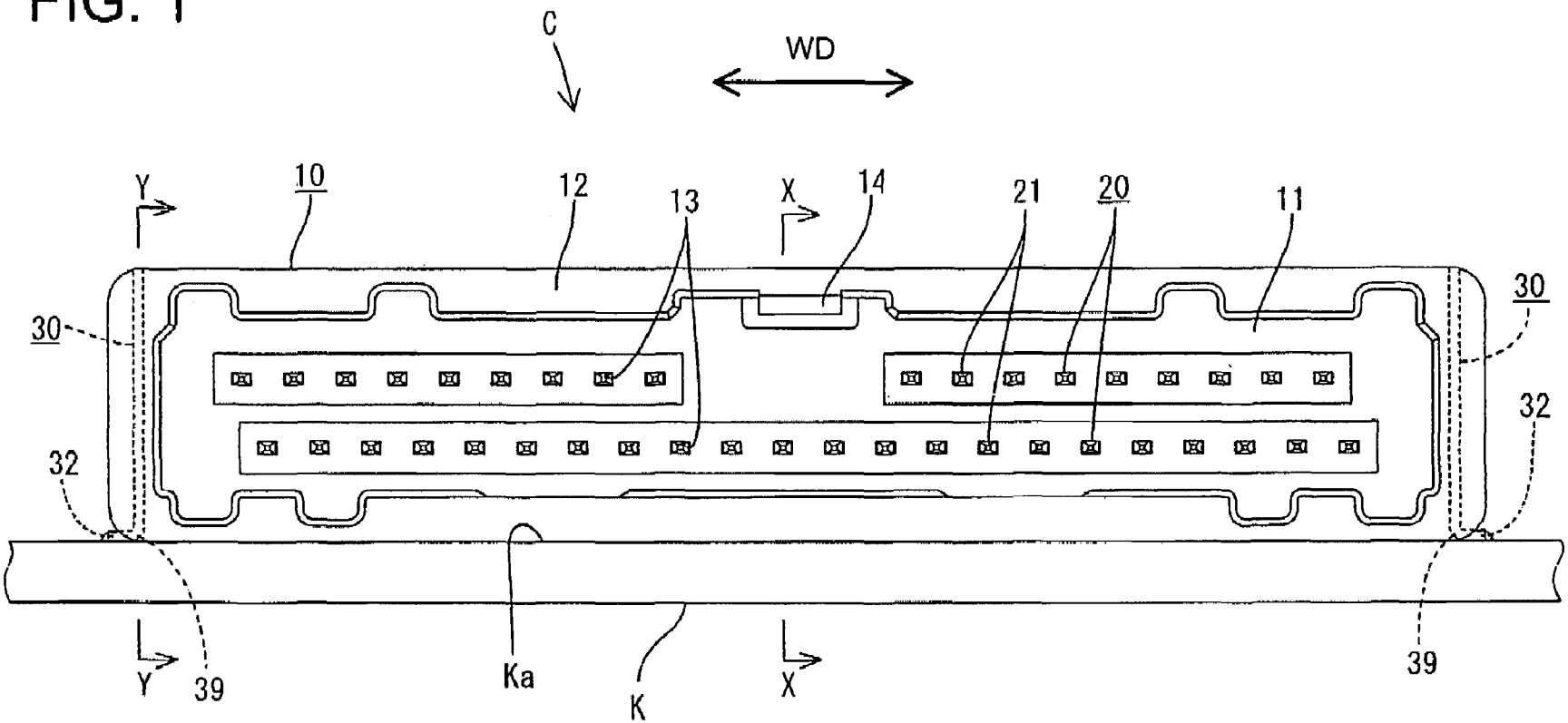
FIG. 1 is a front view of a circuit board connector according to one embodiment of the invention.

The housing 10 is wide and includes a terminal holding portion 11 for holding the terminal fittings 20. A receptacle 12 projects forward from a front peripheral edge of the terminal holding portion 11. The terminal holding portion 11 is formed with terminal insertion cavities 13 and the terminal fittings 20 are insertable the cavities 13 from behind. The terminal insertion holes 13 are arranged substantially side by side along widthwise direction WD at upper and lower stages. More specifically, twenty two terminal insertion holes 13 are arranged at the lower stage, and nine terminal insertion holes 13 are arranged at each of left and right sides of the upper stage as shown in FIG. 1. The terminal insertion holes 13 at the upper stage are offset along the width direction WD from those at the lower stage.

The receptacle 12 is a substantially rectangular tube with an open front end, and the mating housing can fit into the receptacle 12 from the front along a connection direction CD. A lock 14 projects down and in at a substantially widthwise middle position of an upper part of the receptacle 12 for engaging a lock arm of the mating housing to hold the two housings in a connected state. A mount groove 15 is provided in each of the opposite sides of the receptacle 12 for receiving the fixing member 30.

A portion of each terminal fitting 20 that projects back from the terminal holding portion 11 is bent down at a substantially right angle. A bottom end of the downward extending portion is bent substantially normal to extend back substantially along the connecting direction CD. A connector-side connecting portion 21 of each terminal fitting 20 projects forward from the front surface of the terminal holding portion 11 and is surrounded by the receptacle 12. The connecting portion 21 is electrically connectable with a mating terminal in the mating housing. A board-side connecting portion 22 is defined at the rear end of each terminal fitting 20 and is electrically connectable by soldering, (ultrasonic) welding, press-fitting or the like with a conductor path (not shown) printed on an outer surface Ka of the circuit board K. The solder attached to the board-side connecting portion 22 is not shown. The terminal fittings 20 at the upper stage are displaced along the widthwise direction WD from those at the lower stage, but the board-side connecting portions 22 of the terminal fittings 20 at the upper and lower stages are at substantially the same positions with respect to the connecting direction CD (see FIGS. 1 and 2).

Figure 4:
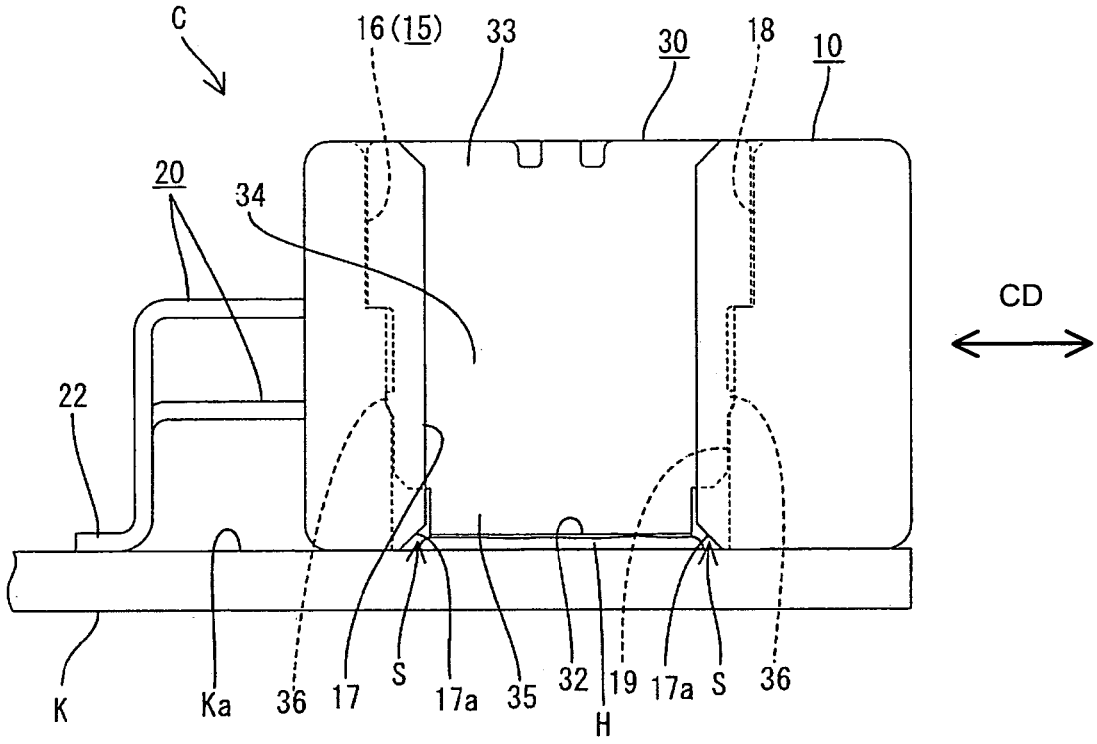
FIG. 4 is a side view of the circuit board connector.
Figure 5:
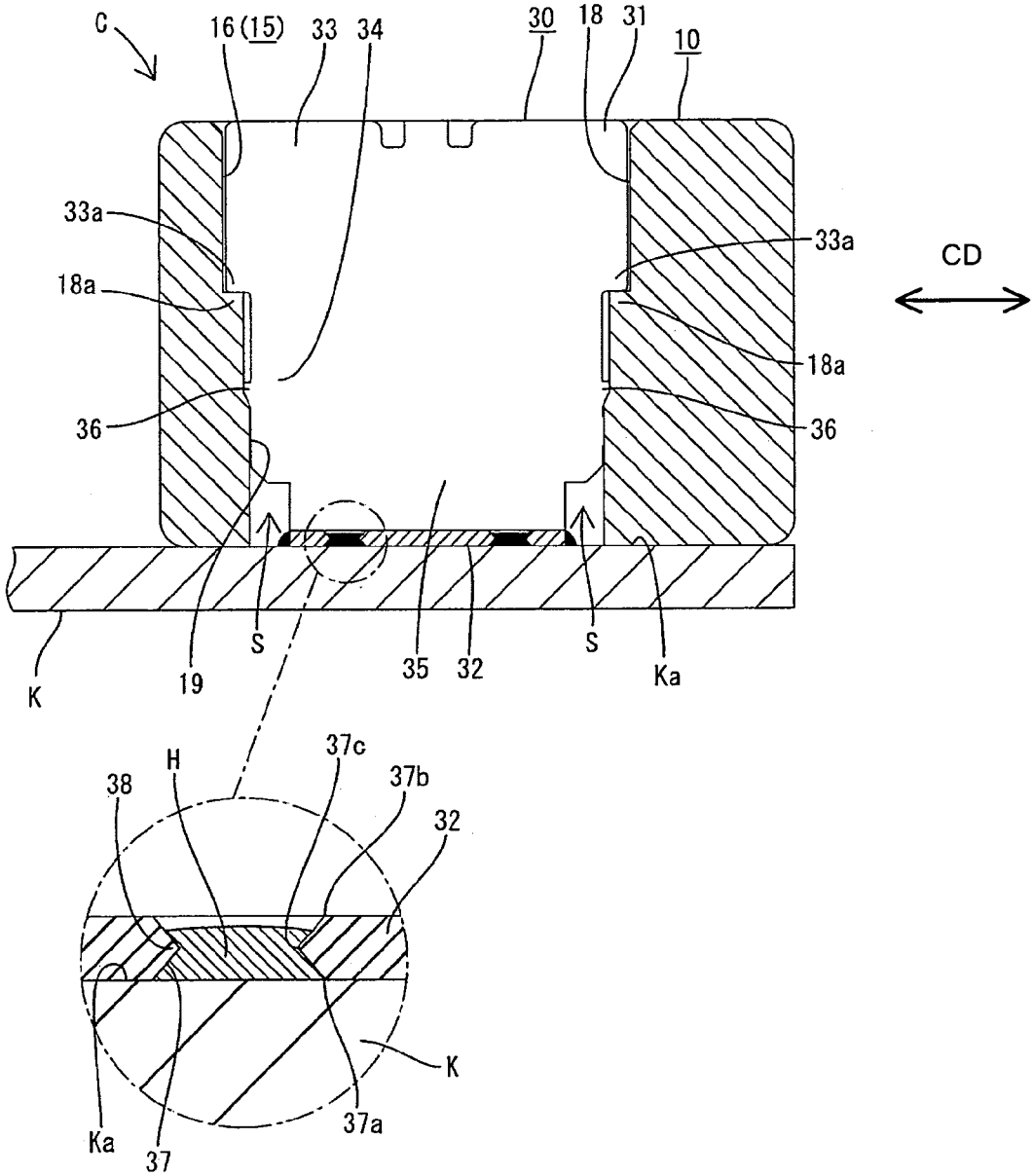
FIG. 5 is a section along 5—5 of FIG. 2.
Figure 6:
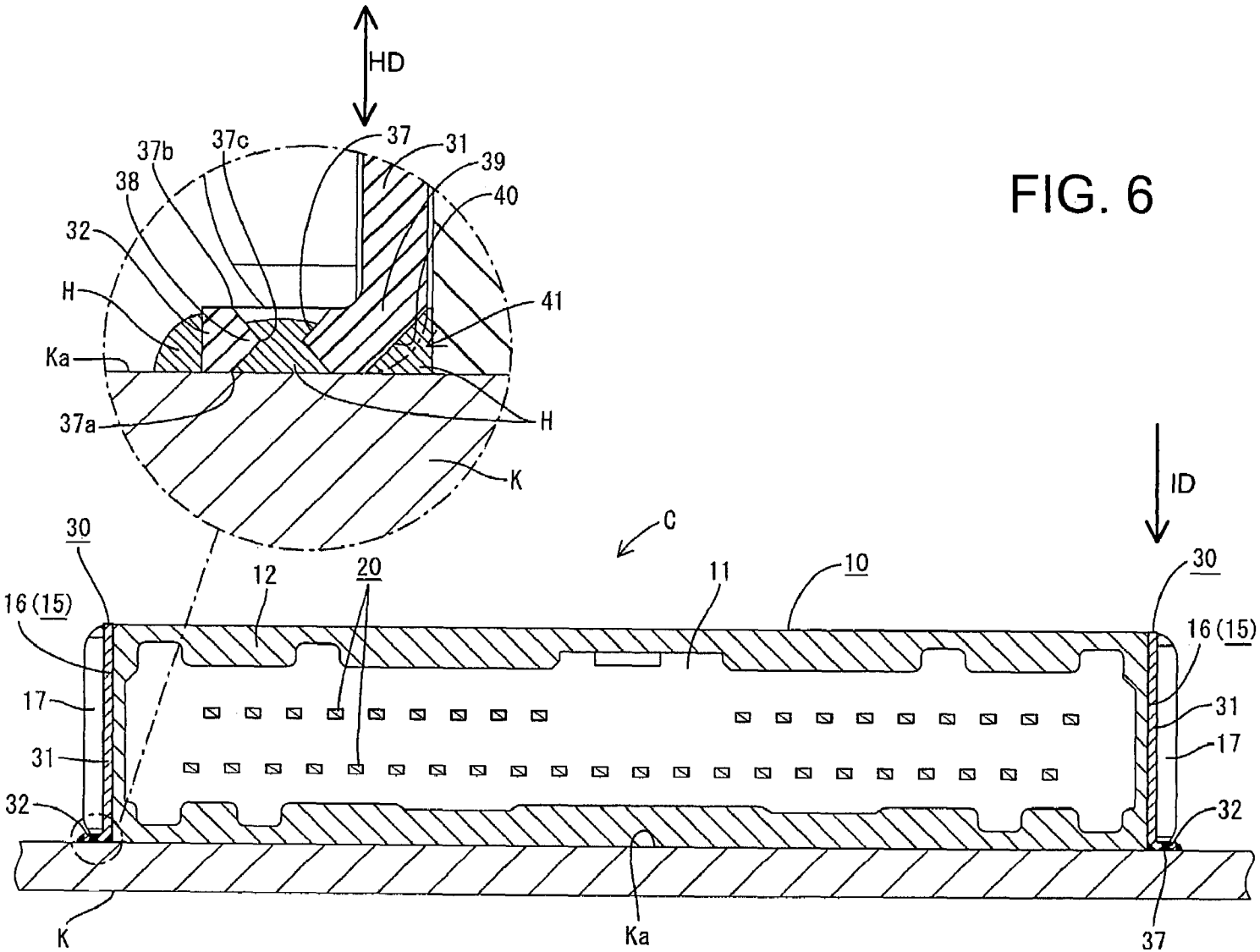
FIG. 6 is a section along 6—6 of FIG. 2.

As shown in FIGS. 4 to 6, each fixing member 30 is made of a rigid metallic plate separate from the housing 10 and is formed by stamping or cutting the metallic plate into a specified shape and then bending, folding or embossing the stamped/cut-out metallic plate. The fixing member 30 has a substantially planar main panel 31 and a solder leg 32 that projects in the width direction WD at a substantially right angle from the bottom end of the main panel 31. Thus, the fixing member 30 is substantially L-shaped in front view (see FIG. 1 or 6). Each mount groove 15 has a main panel accommodating portion 16 for receiving the main panel 31 parallel to its planar surface and along an insertion direction ID. Each mount groove 15 also has a solder leg accommodating portion 17 for receiving the solder leg 32 at a substantially right angle to its planar surface and normal to the insertion direction ID.

As shown in FIGS. 4 and 5, the main panel 31 of each fixing member 30 is stepped to include a wide upper section 33, a middle section 34 and a narrow bottom section 35. On the other hand, the main panel accommodating portion 16 of each mount groove 15 has a wide upper section 18 that is at least as wide as the upper section 33 of the main panel 31 and a narrow lower section 19 that is at least as wide as the middle section 34 of the main panel 31. The solder leg accommodating portion 17 is at least as wide as the narrow bottom section 35 of the main body 31 and the solder leg 32.

Steps 33*a* are defined at the bottom end of the upper section 33 of the main panel 31 and contact steps 18*a* at the bottom end of the wide upper section 18 of the main panel accommodating portion 16 when the fixing member 30 is inserted into the mount groove 15. Thus, the fixing member 30 is positioned so that the bottom surface of the fixing member 30 is substantially flush with the bottom surface of the housing 10. Specified clearances are defined between the narrow bottom section 35 of the main panel 31 and the narrow lower section 19 of the main panel accommodating portion 16 when the fixing member 30 is mounted. These clearances open laterally outward to define solder inflow spaces S that permit the inflow of solder H during the soldering operation. Notches 17*a* are formed at the bottom end of the groove edges of the solder leg accommodating portion 17 to facilitate the inflow of the solder H (see FIG. 4). Two retaining portions 36 project sideways from the opposite side edges of the middle section 34 of the main panel 31. The retaining portions 36 bite into the groove edges of the narrow lower section 19 of the main panel accommodating portion 16 as the fixing member 30 is mounted and hold the fixing member 30 in the mount groove 15. A lateral projecting distance of the solder leg 32 substantially equals the depth of the solder leg accommodating portion 17. Thus, the projecting end of the solder leg 32 is substantially flush with the outer side surface of the housing 10 in the mounted state of the fixing member 30.

Figure 2:
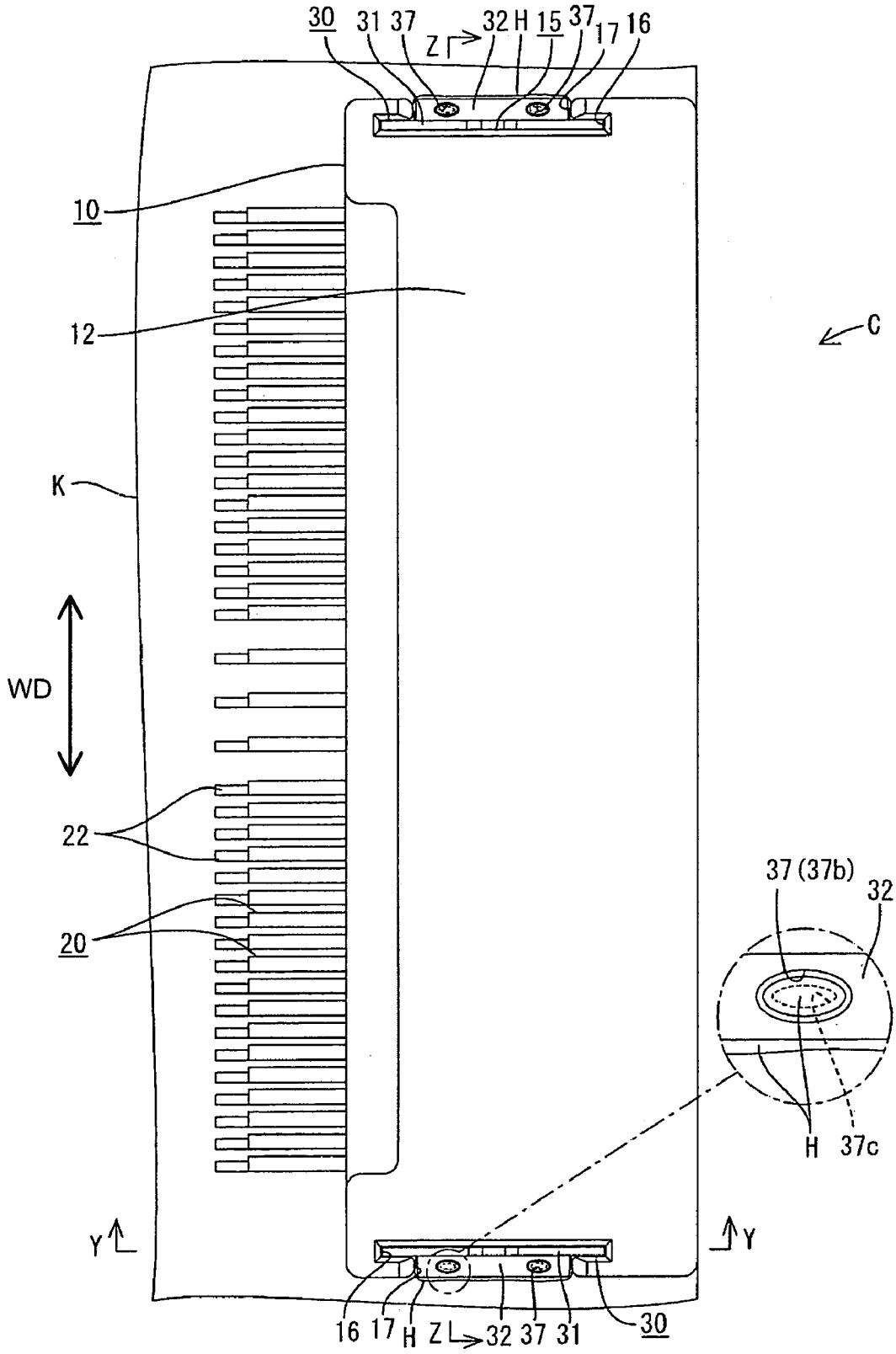
FIG. 2 is a plan view of the circuit board connector.
Figure 3:
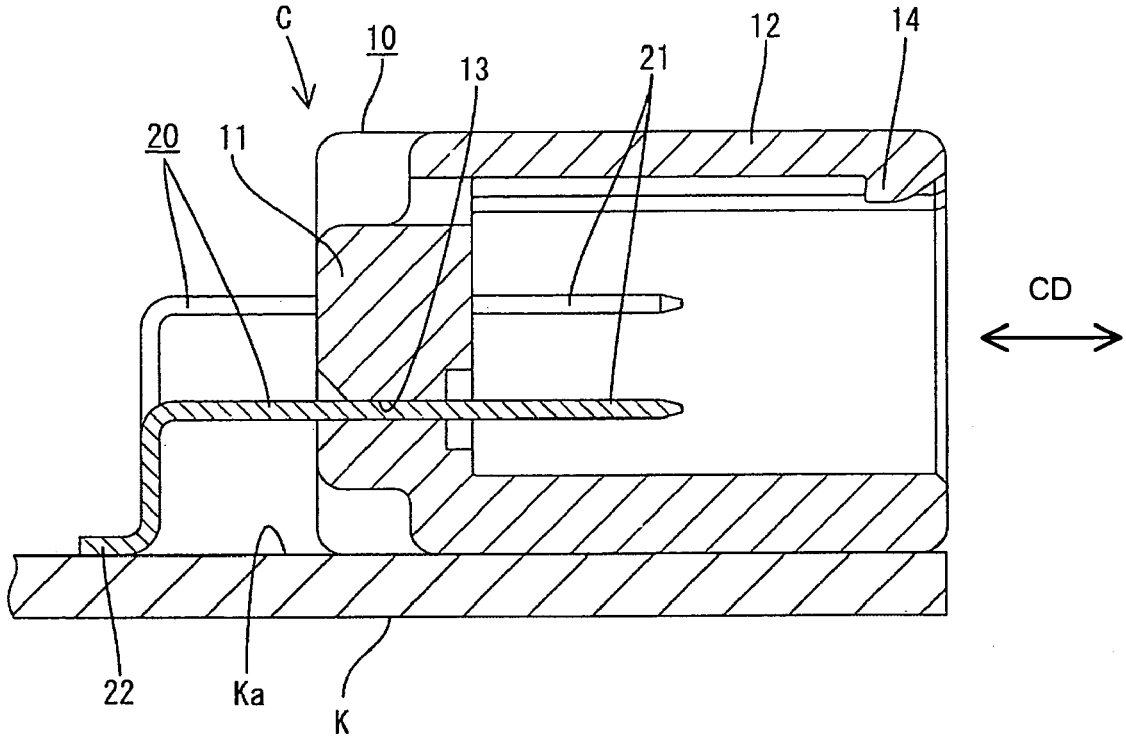
FIG. 3 is a section along 3—3 of FIG. 1.

The solder leg 32 of the fixing member 30 is placed on the outer surface Ka of the circuit board K with the planar surface of the solder leg 32 substantially parallel to the outer surface Ka of the circuit board K. Each solder leg 32 has two solder entering holes 37 that penetrate the respective solder leg 32 along the thickness direction of the solder leg 32 and substantially along the inserting direction ID. Thus, each solder entering hole 37 is open at the side of the solder leg 32 facing towards the circuit board K and an opposite side of the solder leg 32 to permit solder H to flow therethrough. As shown in FIG. 2, each solder entering hole 37 is substantially elliptical in plan view, and is narrow and long along the longitudinal direction of the solder leg 32.

As shown in FIGS. 5 and 6, each solder entering hole 37 extends along a height direction HD from a lower end 37*a* that faces the circuit board K to an upper end 37*b*. The cross-sectional dimensions of each solder entering hole 37 at the lower and upper open ends 37*a*, 37*b* preferably are substantially equal. However, each solder engaging hole 37 has a variable cross-section along the height direction HD, so that an intermediate portion 37*c* between the lower and upper ends 37*a*, 37*b* defines a smaller cross-section than the ends 37*a*, 37*b*. The change in cross-sectional size between the lower and upper ends 37*a*, 37*b* towards the middle portion 37*c* is substantially continuous and gradual along the height direction HD, and preferably is formed by striking, drilling or machining the solder portion 32 from substantially opposite sides. The cross-sectionally small middle portion 37*c* of the solder entering hole 37 defines a locking edge 38 for locking the solder H that has entered the solder entering hole 37. More specifically, the locking edge 38 extends around the entire periphery of the solder entering hole 37 and has a substantially pointed cross-section that bulges to a maximum extent at the middle portion 37*c*. The peripheral surface of the locking edge 38 is comprised of two substantially conical surfaces facing respectively towards and away from the circuit board K, and the upper of those conical surfaces locks the solder H that has entered up to a position higher than the middle portion 37*c*.

As shown in FIG. 6, a bend 39 is defined between the main panel 31 and the solder leg 32 of each fixing member 30, and a slanted escaping surface 40 is formed at an outer edge of the bend 39 facing towards the circuit board K. The escaping surface 40 extends longitudinally over substantially the entire length of the solder leg 32 and is formed by striking or machining the outer edge of the bend 39. Thus, the escaping surface 40 is retracted farther from the circuit board K than an imaginary arcuate surface formed at the outer edge during the bending operation (see phantom line of FIG. 6). The escaping surface 40 defines a clearance between the bend 39 and the circuit board K that is larger than a surface that would be formed merely by the bending operation. This clearance serves as a solder entering space 41 for permitting entry of the solder H. The solder entering space 41 is substantially triangular when viewed from the front or behind.

The solder H is applied beforehand at positions on the outer surface Ka of the circuit board K corresponding to the parts of the circuit board connector C planned to be fixed. Thereafter, the circuit board connector C is positioned on the outer surface Ka of the circuit board K. The circuit board K and the properly positioned circuit board connector C then are passed through a high-temperature oven (not shown), in which hot air is circulated.

The solder applied to the circuit board K is melted by the heat in the oven and is attached to the peripheral edges of the board-side connecting portions 22 of the terminal fittings 20. Additionally, the molten solder H is attached to the peripheral edges of the solder legs 32 of the fixing members 30 and enters the solder entering holes 37 and the solder entering spaces 41 to be attached to the peripheral edges of these holes and spaces. The molten solder H is solidified upon cooling and the respective board-side connecting portions 22 and the solder legs 32 are secured to the circuit board K. In this way, the board-side connecting portions 22 are electrically connected with the corresponding conductor paths of the circuit board K and the solder legs 32 are fixed to the circuit board K.

As shown in FIGS. 5 and 6, the solder legs 32 are fixed by solder H that has entered the solder entering holes 37 and also are fixed by the solder H attached to the peripheral edges of the solder legs 32. Thus, as compared to the prior art solder legs with no solder entering hole, an area of the solder H in contact with the circuit board K is increased by at least as much as the solder entering holes 37, thereby enhancing holding forces of the solder legs 32 onto the circuit board K. In addition, a part of the solder H above the middle portion 37*c* is locked by the corresponding locking portion 38. Thus, the solder H on the locking portions 38 resist forces that could separate the circuit board connector C from the circuit board K and enhance the holding forces of the solder legs 32 onto the circuit board K. The amount of the solder H entering the solder entering holes 37 may be slightly more or less than the shown amount.

The solder entering holes 37 are substantially elliptical in plan view. Thus, the area of soldering is increased further as compared to right circular solder entering holes, and burrs are less likely to be formed at the edges of the solder entering holes 37 as compared to rectangular solder entering holes. Furthermore, the cross-sectional size of each solder entering hole 37 gradually increases towards the open end 37*a* facing the circuit board K. Thus, a larger area of soldering can be ensured at the open end 37*a* at the side of the circuit board K, thereby contributing to the holding force onto the circuit board K. The escaping surfaces 40 are formed at the outer edges of the bends 39 of the fixing members 30. Thus, large solder entering spaces 41 are ensured to provide clearances to the circuit board K. As a result, the area of soldering can be even more increased.

As described above, the solder H is locked by the locks 38 and a sufficiently large area of soldering to the circuit board K is ensured. Therefore, the holding force of the circuit board connector C onto the circuit board K is enhanced, resulting in higher fixing reliability to the circuit board K.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The cross-section of each solder entering hole can be changed. For example, the cross-sectional size may be smallest at portion(s) of the solder entering hole vertically displaced from the substantially middle along the height direction HD. It is not necessary to set the same cross-sectional sizes for both upper and lower open ends, and the hole diameters at the upper and lower open ends may differ. In such a case, the lock is formed by a portion of the hole edge of each solder entering hole bulging in more than the open end at the side opposite from the circuit board.

The shape of the solder entering holes can be changed. For example, they may be right circular in plan view or rectangular in plan view. Instead of the solder entering holes whose cross-sections continuously change as in the foregoing embodiment, the locking portions may be stepped.

Although the solder entering holes are shown in the foregoing embodiment, solder entering recesses may be formed in the solder legs instead. Specifically, the solder entering recess may vertically penetrate the solder portions and be open sideways, or may be open only at the side toward the circuit board without vertically penetrating the solder legs.

The positions and the number of the solder entering holes in the solder legs can be arbitrarily changed.

The soldering method can be changed arbitrarily. For example, soldering may be carried out after the circuit board connector is placed on the circuit board without applying the solder to the circuit board beforehand.

What is claimed is:

1. A connector to be fixed to an electric or electronic device, comprising:

a housing having mounting surface for mounting on the device and a plurality of external side surfaces extending angularly from the mounting surface and away from the device; and at least one fixing member having a main panel mountable to one of the external side surfaces of the housing and a solder leg bent angularly from the main panel and being fixable to the electric or electronic device by soldering, the fixing member including at least one solder entering through hole for receiving solder, and a locking portion on a peripheral edge of the solder entering through hole and configured for locking the solder that has entered the solder entering through hole.

2. The circuit board connector of claim 1, wherein the solder entering through hole has a variable cross-sectional along a height direction that gradually increases from an intermediate portion along the height direction towards the open end facing towards the electric or electronic device and towards a substantially opposite open end.

3. The circuit board connector of claim 1, wherein the main panel is mounted in a mount groove in the housing.

4. The circuit board connector of claim 1, wherein an escaping surface is formed between the main panel and the solder leg and facing substantially towards the electric or electronic device.

5. The circuit board connector of claim 4, wherein the escaping surface extends at a slant between the main panel and the solder leg.

6. The circuit board connector of claim 1, wherein the solder entering through hole has a cross-sectional size that gradually increases towards an open end facing away from the electric or electronic device.

7. The circuit board connector of claim 1, wherein the solder entering through hole is substantially elliptical.

8. The circuit board connector of claim 7, wherein the solder entering through hole has a cross-sectional size that gradually increases toward an open end facing toward the electric or electronic device.

9. A connector to be fixed to a circuit board, said connector comprising:

a housing having a mounting surface for mounting in opposed relationship to the circuit board and a plurality of side surfaces projecting substantially perpendicularly from the mounting surface and away from the circuit board; and a plurality of substantially L-shaped fixing members, each said fixing member having a main panel mounted respectively to one of the side surfaces of the housing and a solder leg extending substantially perpendicularly from the main panel for mounting on the circuit board, the solder leg of each said fixing member having at least one through hole formed therein, each said through hole being formed so that at least a portion of the through hole widens at locations farther from the circuit board to define surface regions for locking solder that has entered the through hole for fixing the circuit board.

10. A connector to be fixed to an electric or electrical device, comprising:

a housing having mounting surface for mounting to the electric or electronic device and at least one side surface extending from the mounting surface, said side surface being formed with a mount groove therein; and at least one fixing member having a main panel mounted in the mount groove of the housing and a solder leg bent angularly from the main panel, the solder leg having at least one solder entering recess that is open at least towards the electric or electronic device for receiving solder, and a locking portion on a peripheral edge of the solder entering recess and configured for locking the solder that has entered the solder entering recess, and an escaping surface being formed between the main panel and the solder leg and facing substantially towards the electric or electronic device.

11. The circuit board connector of claim 10, wherein the escaping surface extends at a slant between the main panel and the solder leg.

* * * * *